US009217264B2

(12) United States Patent
Milton-Benoit et al.

(10) Patent No.: US 9,217,264 B2
(45) Date of Patent: Dec. 22, 2015

(54) LOW ENERGY CLUTCH FOR ELECTRONIC DOOR LOCK

(75) Inventors: John M. Milton-Benoit, West Suffield, CT (US); Ulf J. Jonsson, South Windsor, CT (US); Robert H. Dold, Monson, MA (US); Fanping Sun, Glastonbury, CT (US); Zaffir A. Chaudhry, South Glastonbury, CT (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 746 days.

(21) Appl. No.: 13/201,267

(22) PCT Filed: Feb. 20, 2009

(86) PCT No.: PCT/US2009/001120

§ 371 (c)(1),
(2), (4) Date: Aug. 12, 2011

(87) PCT Pub. No.: WO2010/096034

PCT Pub. Date: Aug. 26, 2010

(65) Prior Publication Data

US 2011/0291428 A1 Dec. 1, 2011

(51) Int. Cl.

| | |
|---|---|
| ***E05B 13/00*** | (2006.01) |
| ***E05B 47/06*** | (2006.01) |
| *E05B 47/00* | (2006.01) |

(52) U.S. Cl.

CPC ..... *E05B 47/0692* (2013.01); *E05B 47/0011* (2013.01); *E05B 2047/0031* (2013.01); (Continued)

(58) Field of Classification Search

CPC . E05B 13/005; E05B 17/0058; E05B 13/101; E05B 47/0692; E05B 2047/0031; E05B 47/0011; F16D 11/16; F16D 28/00; F16D 41/16; F16D 2121/24; F16D 2129/10; Y01T 70/5823; Y01T 70/5827; Y01T 70/5677; Y01T 70/7102; Y01T 292/1061; Y01T 292/57; Y01T 292/03; Y01T 29/49826

USPC ..... 70/188, 189, 218, 222, 223, 277, 278.7, 70/279.1; 192/43.1, 84.6

See application file for complete search history.

(56) References Cited

U.S. PATENT DOCUMENTS

| | | | | |
|---|---|---|---|---|
| 540,025 | A * | 5/1895 | Palmer | 292/144 |
| 1,779,438 | A * | 10/1930 | Lowe | 70/222 |

(Continued)

FOREIGN PATENT DOCUMENTS

| | | | |
|---|---|---|---|
| WO | WO 03/087503 | A1 | 10/2003 |
| WO | WO 2004/077473 | A1 | 9/2004 |

(Continued)

OTHER PUBLICATIONS

The Apr. 30, 2009 International Search Report for the International Application No. PCT/US2009/001120.

*Primary Examiner* — Lloyd Gall
(74) *Attorney, Agent, or Firm* — Cantor Colburn LLP

(57) ABSTRACT

A clutch for an electronic door lock includes a primary mover, a pivotal pawl, a first shaft, and a second shaft. The second shaft is axially co-aligned with the first shaft and is rotatably mounted adjacent the rotatable first shaft. The primary mover is selectively actuatable to engage the pawl such that rotation of the first shaft relative to the second shaft by a user pivots the pawl into coupling engagement between the first shaft and the second shaft.

15 Claims, 17 Drawing Sheets

(52) U.S. Cl.
CPC ..... *Y10T29/49826* (2015.01); *Y10T 70/5677* (2015.04); *Y10T 70/5823* (2015.04); *Y10T 70/5827* (2015.04); *Y10T 70/7102* (2015.04); *Y10T 292/03* (2015.04); *Y10T 292/1061* (2015.04); *Y10T 292/57* (2015.04)

(56) References Cited

U.S. PATENT DOCUMENTS

| | | | | | |
|---|---|---|---|---|---|
| 1,899,686 | A | * | 2/1933 | Henst | 70/222 |
| 1,899,997 | A | * | 3/1933 | Sullivan | 70/222 |
| 2,529,230 | A | * | 11/1950 | Smith et al. | 70/149 |
| 4,671,087 | A | * | 6/1987 | Olenfalk et al. | 70/283 |
| 4,749,072 | A | | 6/1988 | Lichty et al. | |
| 4,833,465 | A | | 5/1989 | Abend et al. | |
| 5,640,863 | A | * | 6/1997 | Frolov | 70/283 |
| 5,884,515 | A | | 3/1999 | Milman | |
| 5,946,955 | A | * | 9/1999 | Suggs et al. | 70/218 |
| 6,067,826 | A | | 5/2000 | Holloway et al. | |
| 6,109,669 | A | | 8/2000 | Pinkow | |
| 6,145,353 | A | * | 11/2000 | Doucet | 70/277 |
| 6,158,259 | A | * | 12/2000 | Schmitz et al. | 70/276 |
| 6,354,121 | B1 | | 3/2002 | Frolov | |
| 6,371,536 | B1 | | 4/2002 | Koerwer et al. | |
| 6,622,535 | B2 | * | 9/2003 | Chiang et al. | 70/107 |
| 6,845,642 | B2 | | 1/2005 | Imedio Ocana | |
| 6,865,916 | B2 | | 3/2005 | Goldman | |
| 6,895,791 | B2 | | 5/2005 | Alexander et al. | |
| 7,051,561 | B2 | | 5/2006 | Moon et al. | |
| 7,270,355 | B2 | | 9/2007 | Powell | |
| 7,275,402 | B2 | * | 10/2007 | Luling et al. | 70/472 |
| 7,966,854 | B2 | * | 6/2011 | Imedio Ocana | 70/472 |
| 2006/0214434 | A1 | | 9/2006 | Powell et al. | |

FOREIGN PATENT DOCUMENTS

| | | | |
|---|---|---|---|
| WO | WO 2005/093191 | A1 | 10/2005 |
| WO | WO 2007/049040 | A1 | 5/2007 |
| WO | WO 2007/083136 | A1 | 7/2007 |
| WO | WO 2007/088365 | A1 | 8/2007 |

* cited by examiner

LOW ENERGY CLUTCH FOR ELECTRONIC DOOR LOCK

BACKGROUND

The present invention relates to a door lock, and more particularly to a clutch for an electronic door lock.

Electronic door locks typically include a mechanical lock and an electronic control for authorizing the use of the mechanical lock. A portion of the mechanical lock secures the door to the door frame. The electronic control may include, for example, a reader that permits data to be read from a coded medium such as a magnetic card, proximity card, or memory key. When a card or key with valid data is presented to the electronic control, the control permits an outer handle or door knob to operate a shaft of the mechanical lock by actuating a prime mover to either release a latch that was preventing the handle or knob from turning, or engage a clutch that couples a shaft of the handle or knob to the shaft of the mechanical lock.

The mechanical lock and electronic control components (including the prime mover and latch/clutch) of electronic door locks are commonly powered by alkaline batteries which typically have a service life of between about two to three years. This limited battery service life necessitates changing the batteries several times over the service life of the door lock; a process that increases the operating costs of businesses which employ the electrical locks. One of the keys for extending battery life and reducing business operating costs is developing a more efficient clutch because the clutch in an electronic door lock typically consumes about 70 percent of the energy the entire lock system utilizes.

SUMMARY

In one aspect, a clutch for an electronic door lock includes a primary mover, a pivotal pawl, a first shaft, and a second shaft. The second shaft is axially co-aligned with the first shaft and is rotatably mounted adjacent the rotatable first shaft. The primary mover is selectively actuatable to engage the pawl such that rotation of the first shaft relative to the second shaft by a user pivots the pawl into coupling engagement between the first shaft and the second shaft.

In another aspect, a method of coupling an first shaft with an second shaft in an electronic door lock using a pivotal pawl, the method includes actuating a prime mover to eliminate a clearance between a movable mechanism and the pawl. The first shaft is rotated to engage the mechanism with the pawl to pivot the pawl into engagement between the first shaft and the second shaft.

DETAILED DESCRIPTION

Figure 1:
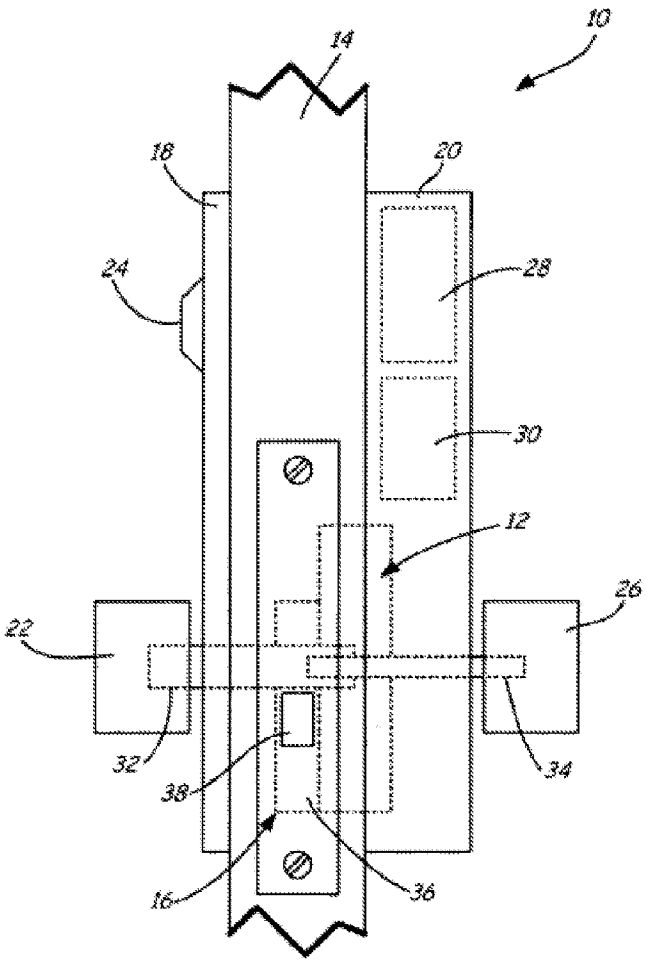
FIG. 1 is a schematic view an electronic door lock including a low energy clutch.

FIG. 1 is a schematic view of an electronic door lock 10 including a low energy clutch 12. The door lock 10 is disposed in a door 14. The door lock 10 includes a latch mechanism 16, an outer escutcheon 18, and an inner escutcheon 20. The outer escutcheon 18 includes an outer handle or knob 22 and a reader 24. The inner escutcheon 20 includes an inner handle or knob 26, a control circuit 28, and batteries 30. Additionally, the door lock 10 includes a handle shaft 32 and a lock shaft 34. The latch mechanism 16 includes a body 36 and a bolt and/or latch 38.

The electronic lock 10 extends through the door 14 between an interior side and an outer side. The door 14 can be part of vehicle or part of a residential/commercial/hospitality structure. The clutch 12, latch mechanism 16, outer escutcheon 18, and inner escutcheon 20 are partially housed within a mortise in the door 14. The electronic lock 10 includes the outer escutcheon 18 which extends from the outer side of the door 14, and the inner escutcheon 20 which extends from the interior side of the door 14.

The outer escutcheon 18 is adapted with the reader 24 to receive a coded medium such as a magnetic card, proximity card, or memory key. The outer handle 22 rotatably projects from the lower portion of the outer escutcheon 18. Interfacing the outer escutcheon 18 on the interior portion of the door 14 is the inner escutcheon 20. The inner escutcheon 20 houses the control circuit 28 and batteries 30 therein. The inner handle 26 rotatably projects from a lower portion of the inner escutcheon 20. The inner handle 26 connects to the lock shaft 34 which is rotatably mounted to extend through the inner escutcheon 20 into the clutch 12 in the door 14. The lock shaft 34 connects to the body 36 of the latch mechanism 16. The body 36 actuates or allows the latch 38 to be actuated out of a door frame when unlocked. When the latch mechanism 16 is locked, the body 36 retains the latch 38 in the door frame. The clutch 12 selectively couples the lock shaft 34 with the handle shaft 32. The handle shaft 32 is rotatably mounted in the outer escutcheon 18 and extends therethrough to connect with the outer handle 22.

When the electronic lock 10 (and hence the latch mechanism 16) is in a locked state, the handle shaft 32 can be rotatably actuated by the user's depressing or rotating the outer handle 22. However, the rotation of the handle shaft 32 is independent of the lock shaft 34 which disposed adjacent to and is not in contact with the handle shaft 32. Thus, the latch mechanism 16 does not respond to the user's rotation of the outer handle 22 and the electronic lock 10 remains locked.

The reader 24 is electrically connected to the control circuit 28 which can be activated to supply power through wiring to a drive assembly in the clutch 12. The batteries 30 provide power for the components of the electronic lock 10 including the reader 24, control circuit 28, and clutch 12.

For the electronic lock 10 and latch mechanism 16 to enter an unlocked state allowing the user to open the door 14, a valid key card (or other coded medium) is presented to the reader 24 by the user. The reader 24 signals the control circuit 28 which electronically activates the drive assembly to drive the clutch 12. The drive produced by the drive assembly on the clutch 12, in combination with the actuation of the handle shaft 32 by the user, moves a portion of the clutch 12 into engagement with both of the shafts 32 and 34 to couple them together. This engagement allows the shafts 32 and 34 be rotated together to unlock the latch mechanism 16.

The clutch 12 utilizes low energy in the range of several millijoules to couple the shafts 32 and 34 due to the use of human (user) torque to rotate the handle shaft 32, which is primarily responsible for moving the clutch 12 into engagement with both shafts 32 and 34. In contrast, the drive assembly only works to move a small leaf spring component of the clutch 12. The resulting reduction in operating resistance or load to the drive assembly that drives the clutch 12 allows the size of the drive assembly (specifically the prime mover of the drive assembly) to be reduced, increases the service life of the batteries 30, and reduces the cost of drive assembly and electronic lock 10.

The configuration of the electronic lock shown in FIG. 1 is exemplary, and therefore, neither the arrangement of the lock components nor the type of components illustrated are intended to be limiting in any way. FIG. 1 simply illustrates an embodiment of an electronic lock that would benefit from the low energy clutch disclosed herein.

Figure 2:
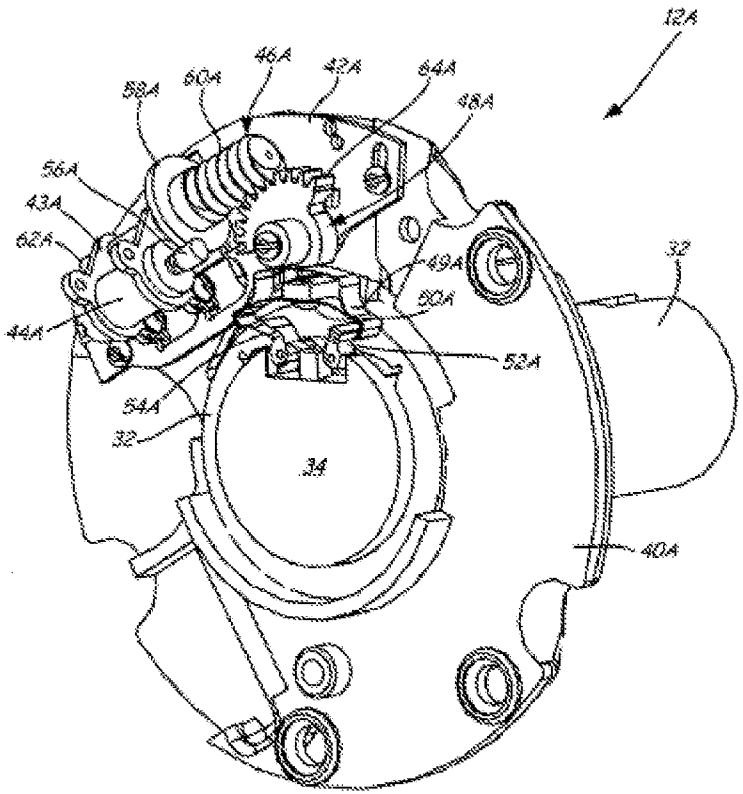
FIG. 2 is a perspective view of one embodiment of the clutch.

FIG. 2 is a perspective view of one embodiment of the clutch 12A with a section of the lock shaft 34 removed to illustrate the components of the clutch 12A. The clutch 12A includes a mounting plate 40A, an actuator plate 42A, brackets 43A, a prime mover 44A, a gear train 46A, a cam 48A, a spring 49A, a spring fastener 50A, a first pawl 52A and a second pawl 54A. The prime mover 44A includes an output shaft 56A. The gear train 46A includes a first gear 58A, a worm gear 60A, and a bushing 62A. The cam 48A includes gear teeth 64A.

In FIG. 2, the mounting plate 40A of the clutch 12A is rotatably connected to the handle shaft 32. The mounting plate 40A is affixed within the mortise of the door 14, the inner escutcheon 20, or outer escutcheon 18 by fasteners (FIG. 1). The lock shaft 34 is axially co-aligned with the axis of rotation of the handle shaft 32. The portion of the lock shaft 34 shown is disposed adjacent the handle shaft 32 and extends within a recess in the handle shaft 32 in one embodiment.

The actuator plate 42A is mounted to an outer portion of the mounting plate 40A. The brackets 43A secure the prime mover 44A and the gear train 46A to the actuator plate 42A. A portion of the prime mover 44A rotatably connects with and drives the gear train 46A. The gear train 46A rotatably interconnects with the cam 48A which is pivotally secured to the actuator plate 42A.

The cam 48A is disposed to pivotally contact the spring 49A when selectively actuated by the prime mover 44A via the gear train 46A. The spring 49A is secured to the handle shaft 32 by the spring fastener 50A and terminates adjacent the first and second pawls 52A and 54A. The pawls 52A and 54A are pivotally secured to and extend outward from the lock shaft 34. When engaged by the spring 49A, a portion of pawl 52A or 54A rotates outward from the lock shaft 34 to engage the handle shaft 32.

More particularly, the prime mover 44A is selectively operable to rotate the output shaft 56A. The output shaft 56A contacts and rotates the first gear 58A which can include gear teeth. The first gear 58A rotatably connects to the output shaft 56A. The first gear 58A is secured to and rotates a shaft (not shown) which extends therethrough. The shaft connects to the worm gear 60A to one side of the first gear 58A and the bushing 62A to the other side of the first gear 58A. The bushing 62A rotatably receives the shaft and is in turn received by the brackets 43A. The worm gear 60A rotates and intermeshes with the gear teeth 64A on the cam 48A to pivot the cam 48A about a stud, portion of the actuator plate 42A, or fastener received in the aperture 66A of the cam 48A.

The pivoting motion of the cam 48A brings it into selective contact with the spring 49A. The cam 48A deflects the spring 49A generally inward toward the lock shaft 34 to eliminate a radial clearance between the spring 49A and the pawls 52A and 54A. The handle shaft 32 can then be rotationally actuated by the user to eliminate a circumferential clearance between the spring 49A and one of the pawls 52A or 54A. The rotation of the handle shaft 34 engages the spring 49A with one of the pawls 52A or 54A, the contacted pawl 52A or 54A pivots in response to the engagement into with the handle shaft 32 to couple the lock shaft 34 with the handle shaft 32.

Although the primary mover 44A is illustrated as an electric motor in FIG. 2, another actuator such as a bi-metallic material or piezoelectric bender could be used to engage and pivot the pawl in lieu of the cam, worm gear, and actuation mechanisms shown. Alternatively, the piezoelectric bender, electrical motor, bi-metallic material, etc. could utilize alternative actuation mechanisms, for example, a pin/dowel that moves down linearly into position to contact the pawl. In another embodiment, the spring could be secured to the lock shaft 34 or another portion of the lock 10 such as the mounting plate 40A and the pawl to the handle shaft 32 rather than the handle shaft 32 and lock shaft 34 as illustrated in FIG. 2. In this alternative configuration, the spring would engage and pivot the pawl into coupling engagement with the lock shaft 34 rather than the handle shaft 32 as illustrated.

Figure 3A:
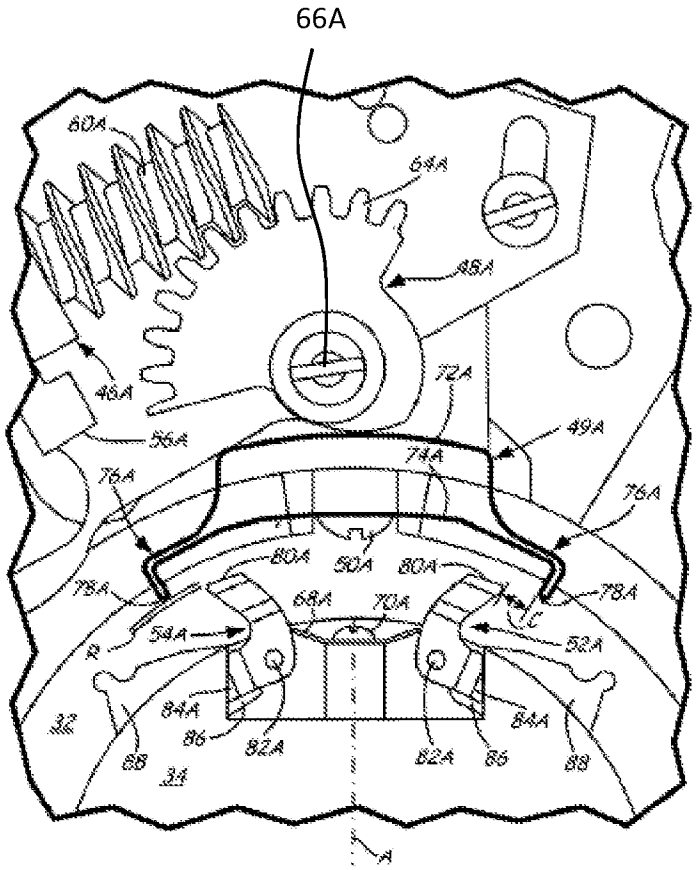
FIG. 3A is a view of the embodiment of the clutch from FIG. 2 in a locked position.

FIG. 3A shows the clutch 12A in the locked position with a section of the lock shaft 34 removed. The clutch 12A includes return springs 68A and a return spring fastener 70A. The spring 49A is doubled over upon itself to include an outer portion 72A and an inner portion 74A which interconnect at end portions 76A. The end portions 76A are adapted to include legs 78A. The first and second pawls 52A and 54A each include a pilot portion 80A, an aperture 82A, and a primary portion 84A. The lock shaft 34 includes recesses 86. The handle shaft 32 includes recesses 88.

The lock shaft 34 is adapted to receive the return springs 68A therein. The return springs 68A are secured to the lock shaft 34 by the return spring fastener 70A. The springs 68A extend to contact the pawls 52A and 54A.

In the locked position illustrated, the spring 49A is disposed relative to the cam 48A such that a radial clearance R exists between the pilot portion 80A and the legs 78A of the spring 49A. In the locked position, the outer portion 72A extends generally circumferentially below the cam 48A. Similarly, the inner portion 74A which is secured to the handle shaft 32 by spring fastener 50A and extends generally circumferentially to either side thereof. The outer portion 72A and inner portion 74A meet at the doubled over end portions 76A. The end portions 76A have legs 78A which extend generally radially inward toward the lock shaft 34 and are adapted to engage the pilot portion 80A of pawls 52A and 54A. The legs 78A terminate leaving radial clearance R between the legs 78A and the pilot portion 80A of the pawls 52A and 54A. The legs 78A are also disposed at a circumferential distance C to either side of the pilot portion 80A of the pawls 52A and 54A.

In the locked position, the pilot portion 80A of pawls 52A and 54A extend generally radially outward from the lock shaft 34 and terminate radially below each leg 78A of the spring 49A. The aperture 82A extends through the inner part of the pilot portion 80A and is adapted to receive a fastener or stud (not shown) which pivotally secures each pawl 52A and 54A to the lock shaft 34. The pilot portion 80A interconnects with the primary portion 84A which is received in recess 86 when the cam 12A is in the locked position. In the locked position, recesses 88 are located generally radially and circumferentially outward of the primary portion 84A of each pawl 52A and 54A. The recesses 88 extend into an interior portion of the handle shaft 32.

The handle shaft 32 and lock shaft 34 are biased into the locked position by return springs (not shown) which engage and rotate the shafts 32 and 34 to the position shown when the handle shaft 32 is not being actuated by the user. In the locked position, the prime mover 44A has not been actuated by the user, and therefore, the cam 48A does not contact the upper portion 72A of the spring 49A. Thus, the radial clearance R exists between the spring 49A and the pawls 52A and 54A and keeps the spring 49A from engaging one of the pawls 52A and 54A if the handle shaft 34 is rotated by the user.

Figure 3B:
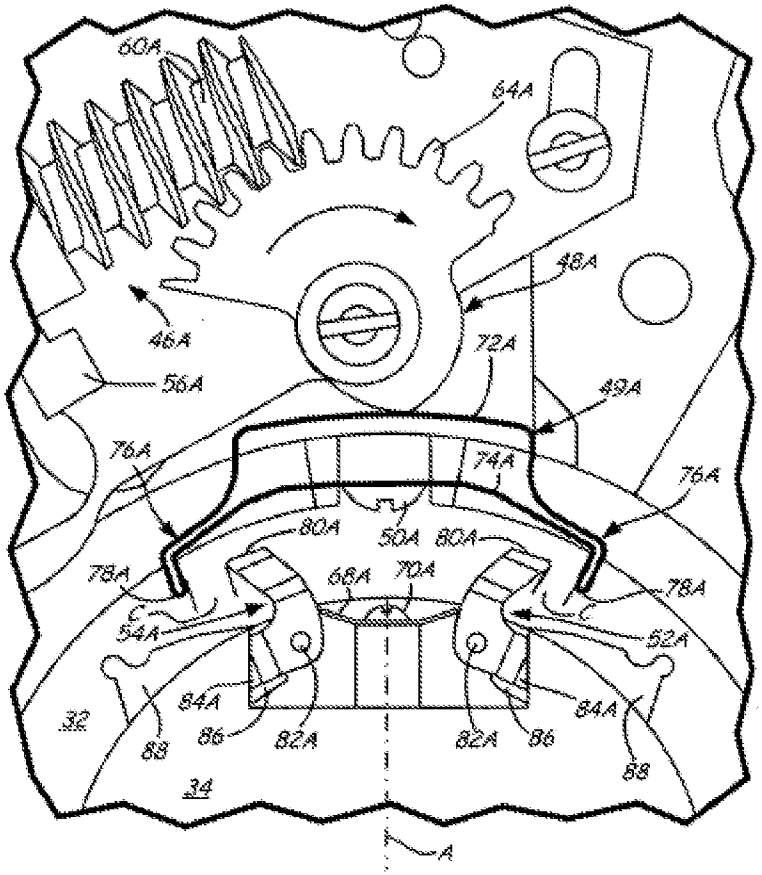
FIG. 3B is a view of the clutch from FIG. 3A with a cam rotated to depress a spring which is secured to a handle shaft.

FIG. 3B shows the cam 48A rotated to depress the spring 49A and eliminate the radial clearance R shown in FIG. 3A. In FIG. 3B, the prime mover 44A has been actuated by the user to drive the gear train 46A to rotate the cam 48A. The pivotal rotation of the cam 48A depresses the outer and inner portions 72A and 74A of the spring 49A, flexing them inward toward the lock shaft 34. The flexing of the outer and inner portions 72A and 74A moves the legs 78A inward to eliminate the radial clearance R (FIG. 3A) between the legs 78A and the pilot portion 80A of the pawls 52A and 54A, circumferential clearance C still exists between the pilot portion 80A and the legs 78A.

Figure 3C:
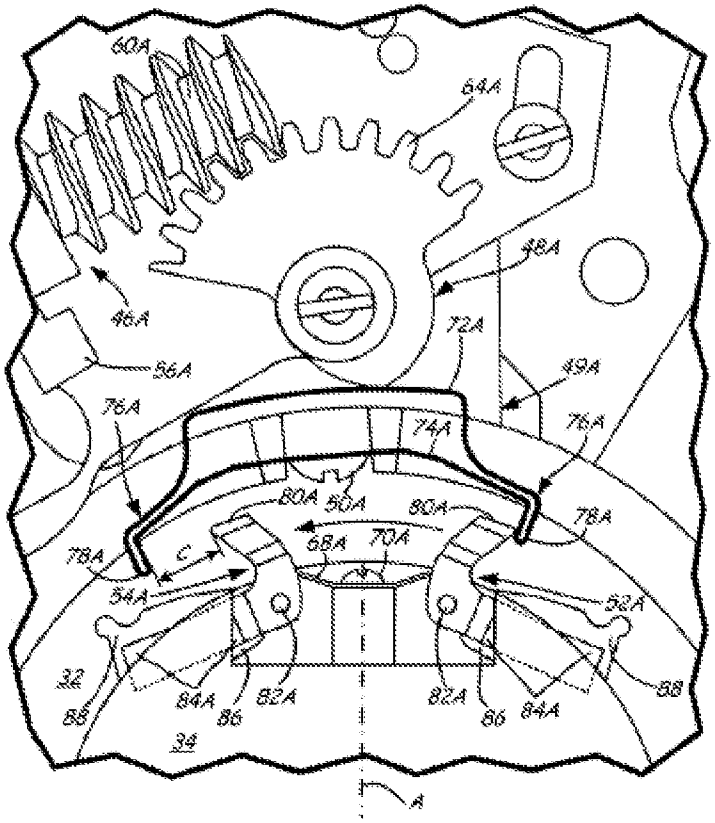
FIG. 3C is a view of the clutch from FIG. 3A with the handle shaft rotated to engage the spring with a pawl.

FIG. 3C shows the handle shaft 32 rotating counterclockwise to initially engage the spring 49A with the pawl 52A. In FIG. 3C, the cam 48A continues to be pivoted to engage the outer portion 72A of the spring 49A. This engagement depresses the spring 49A to eliminate the radial clearance R (FIG. 3A) between the legs 78A and the pilot portion 80A of the pawls 52A and 54A. The handle shaft 32 rotates counterclockwise in response to the user depressing or rotating the outer handle 22 (FIG. 1). This counterclockwise rotation brings the spring 49A (which is secured to the handle shaft 32) into engagement with the pawl 52A. More particularly, one leg 78A of the spring 49A engages the pilot portion 80A of the pawl 52A while a circumferential clearance C remains between the other leg 78A and pawl 54A. The engagement of the leg 78A with the pilot portion 80A places the inner portion 74A of the spring 49A between the leg 78A and the spring fastener 50A in tension.

The first pawl 52A and the second pawl 54A are disposed symmetrically on an opposite sides of an axis of symmetry A of the lock shaft 34. The dual pawl 52A and 54A arrangement allows for bi-directional engagement of the spring 49A with either pawl 52A or 54A to couple the lock shaft 34 with the handle shaft 32. Bi-directional coupling means the user can turn the outer handle 22 (FIG. 1) in either a clockwise or counterclockwise direction (thus rotating the handle shaft 32 in the clockwise or counterclockwise direction) and still engage one leg 78A of the spring 49A with either the first pawl 52A or the second pawl 54A. The spring 49A is doubled over upon itself such that when selectively engaged by the cam 48A the outer portion 72A of the spring 49A deflects to a greater extent than an inner portion 74A of the spring 49A. The greater deflection of the outer portion 72A relative to the inner portion 74A exerts a bias force on the pawl 52A when the spring 49A is engaging the pawl 52A. In FIG. 3C, this bias force tends to want to pivot the pilot portion 80A of the pawl 52A inward toward the axis of symmetry A and the primary portion 84A of the pawl 52A outward to engage the handle shaft 32.

Figure 3D:
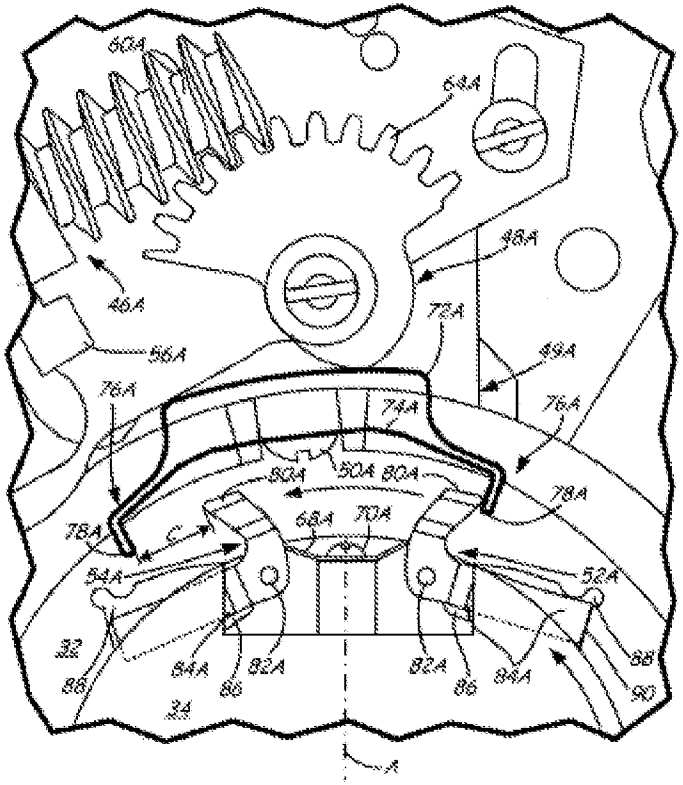
FIG. 3D is a view of the clutch from FIG. 3A with the handle shaft rotated further counterclockwise such that the spring engaging the pawl has moved a portion of the pawl into a recess in the handle shaft.

FIG. 3D shows the primary portion 84A of the first pawl 52A rotating into recess 88 thereby engaging the pawl 52A with the handle shaft 32. In FIG. 3D, the recess 88 has moved into a position outward of the pawl 52A due to the rotation of the handle shaft 32 relative to the lock shaft 34 while the primary portion 84A has rotated outward due to the engagement of the spring 49A on the pilot portion 80A. More particularly, the primary portion 84A engages a trailing edge surface 90 which defines a portion of the recess 88 to couple the lock shaft 34 with the handle shaft 32.

The clutch 12A utilizes low energy to couple the shafts 32 and 34 due to the use of human (user) torque to rotate the handle shaft 32 into engagement with one of the pawls 52A or 54A. In contrast, the prime mover 44A via the gear train 46A and cam 48A only works to deflect the spring 49A a small radial distance so that the leg 78A of the spring 49A interfaces with and engages the pilot portion 80A of the pawl 52A or 54A when the handle shaft 32 is rotated by the user. The resulting reduction in operating resistance or load to the prime mover 44A allows the size of the prime mover 44A to be reduced, increases the service life of the batteries 30, and reduces the cost of prime mover 44A and the overall cost of the electronic lock 10. Because the clutch 12A utilizes mainly rotational motion to engage the cam 48A with the spring 49A, the spring 49A with the pawl 52A or 54A, and the pawl 52A or 54A with the handle shaft 32 there are only limited instance(s) of sliding friction in the clutch 12A. Thus, the use of rotational motion engagement in the clutch 12A improves clutch 12A reliability by reducing the likelihood of stiction or binding problems due to the sliding friction prevalent in linear clutch devices.

Figure 3E:
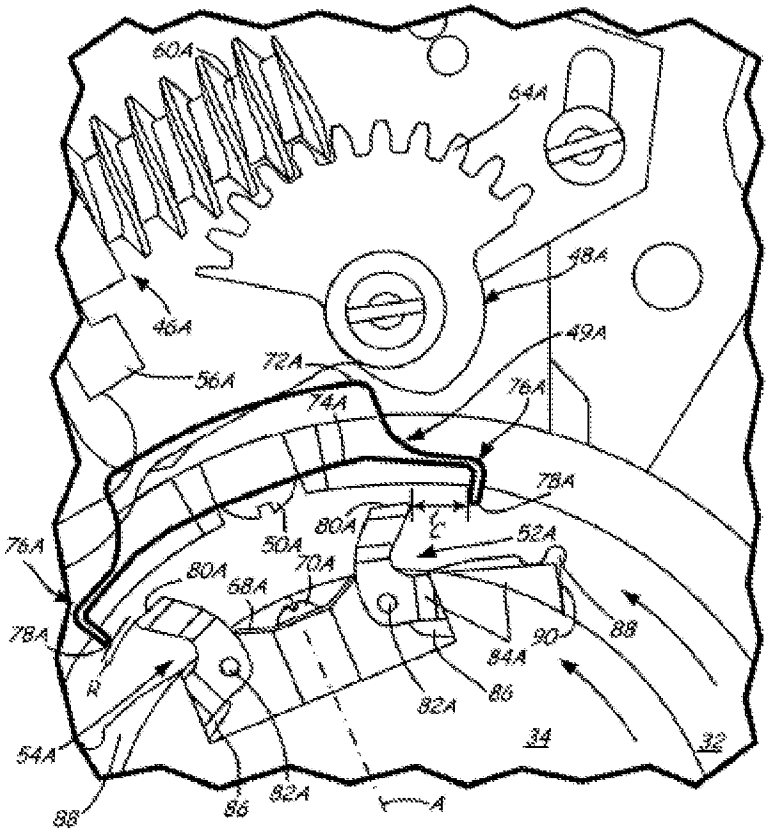
FIG. 3E is a view of the clutch from FIG. 3A with the clutch in an unlocked position.

FIG. 3E shows the clutch 12A in an unlocked position. In the unlocked position, the lock shaft 34 and handle shaft 32 have rotated together to unlock the latch mechanism 16 to allow the user to open the door 14 from an exterior side (FIG. 1). The spring 49A has rotated free of contact with the cam 48A. In the embodiment shown, the radial clearance R has developed between the legs 78A and the pilot portion 80A of each pawl 52A and 54A. In another embodiment, the legs 78A and pilot portion 80A can be adapted to maintain engagement once initially engaged despite the lack of inward cam 48A engagement on spring 49A. The primary portion 84A of the pawl 52A is held in engagement with surface 90 by friction and normal forces caused by the return springs (not shown) engaging the handle shaft 32 and lock shaft 34. As discussed earlier when discussing FIG. 3A, if the user releases the outer handle 22, the shafts 32 and 34 will return to neutral locked positions as illustrated in FIG. 3A. The cam 48A can be rotated back to a non-engaging position above the spring 49A such that the spring 49A is not deflected as it is brought back under the cam 48A. Once in the neutral locked position, the return springs 68A bias the primary portion 84A of pawl 52A back into the recess 86.

Figure 4:
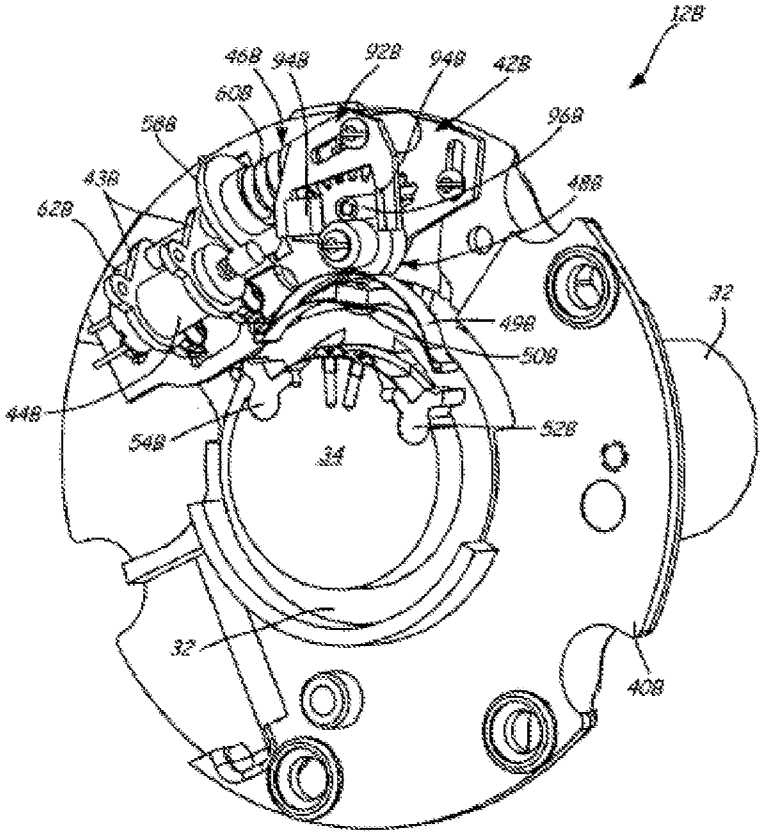
FIG. 4 is a perspective view of another embodiment of the clutch.

FIG. 4 shows a perspective view of another embodiment of clutch 12B with a section of the lock shaft 34 removed to illustrate the components of the clutch 12B. The clutch 12B includes a mounting plate 40B, an actuator plate 42B, brackets 43B, a prime mover 44B, a gear train 46B, a cam 48B, a spring 49B, a spring fastener 50B, a first pawl 52B and a second pawl 54B. The prime mover 44B includes an output shaft 56B. The gear train 46B includes a first gear 58B, a worm gear 60B, and a bushing 62B. The cam 48B includes gear teeth 64B and an aperture 66B. The clutch 12B also includes a fork 92B. The fork 92B includes arms or tines 94B. The cam 48B includes a projection 96B.

In FIG. 4, the mounting plate 40B of the clutch 12B rotatably receives the handle shaft 32. The mounting plate 40B is affixed within the mortise of the door 14, the inner escutcheon 20, or outer escutcheon 18 by fasteners (FIG. 1). The lock shaft 34 is axially co-aligned with the axis of rotation of the handle shaft 32. The portion of the lock shaft 34 shown is disposed adjacent the handle shaft 32 and extends within a recess in the handle shaft 32 in one embodiment.

The actuator plate 42B is mounted to an outer portion of the mounting plate 40B. The brackets 43B secure the prime mover 44B and the gear train 46B to the actuator plate 42B. A portion of the prime mover 44B rotatably connects with and drives the gear train 46B. The gear train 46B rotatably interconnects with the cam 48B which is pivotally secured to the actuator plate 42B.

The cam 48B is disposed to pivotally contact the spring 49B when selectively actuated by the prime mover 44B via the gear train 46B. The spring 49B is secured to the handle shaft 32 by the spring fastener 50B and terminates adjacent the first and second pawls 52B and 54B. The pawls 52B and 54B are pivotally secured to and extend outward from the lock shaft 34. When engaged by the spring 49B, a portion of pawl 52B or 54B rotates outward from the lock shaft 34 to engage the handle shaft 32.

More particularly, the prime mover 44B is selectively operable to rotate the output shaft 56B. The output shaft 56B contacts and rotates the first gear 58B which can include gear teeth. The first gear 58B rotatably connects to the output shaft 56B. The first gear 58B is secured to and rotates a shaft (not shown) which extends therethrough. The shaft connects to the worm gear 60B to one side of the first gear 58B and the bushing 62B to the other side of the first gear 58B. The bushing 62B rotatably receives the shaft and is in turn received by the brackets 43B. The worm gear 60B rotates and intermeshes with the gear teeth 64B on the cam 48B to pivot the cam 48B about a stud, portion of the actuator plate 42B, or fastener received in the aperture 66B of the cam 48B. The fork 92B is secured to the actuator plate 42B and the tines 94B of the fork 92B extend downward to adjacent either side of the cam 48B. The cam 48B is disposed such that the projection 96B extends between the tines 94B. The projection 96B contacts the tines 94B which act as stops to limit the pivotal rotation of the cam 48B.

The pivoting motion of the cam 48B brings it into selective contact with the spring 49B. The cam 48B deflects the spring 49B generally inward toward the lock shaft 34 to eliminate a radial clearance between the spring 49B and the pawls 52B and 54B. The handle shaft 34 can then be rotationally actuated by the user to eliminate a circumferential clearance between the spring 49B and one of the pawls 52B or 54B. The rotation of the handle shaft 34 engages the spring 49B with one of the pawls 52B or 54B, the contacted pawl 52B or 54B pivots in response to the engagement into with the handle shaft 32 to couple the lock shaft 34 with the handle shaft 32.

Figure 5A:
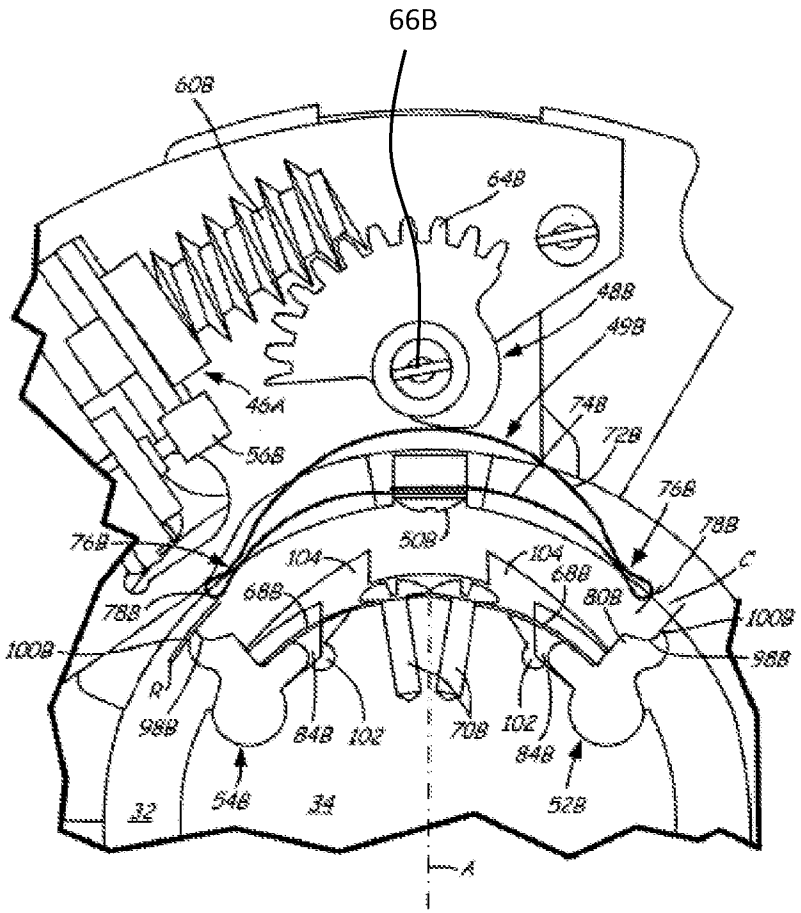
FIG. 5A is a view of the embodiment of the clutch from FIG. 4 in a locked position.

FIG. 5A shows the clutch 12A from FIG. 4 in the locked position with a section of the lock shaft 34 removed. The clutch 12B includes return springs 68B and return spring fasteners 70B. The spring 49B is doubled over upon itself to include an outer portion 72B and an inner portion 74B which interconnect at end portions 76B. The end portions 76B are adapted to include legs 78B. The first and second pawls 52B and 54B each include a pilot portion 80B and a primary portion 84B. The pilot portion 80B includes a cradle 98B and a lip 100B. The lock shaft 34 includes recesses 102, and the handle shaft 32 includes recesses 104.

The lock shaft 34 is adapted with to receive the return springs 68B therein. The return springs 68B are secured to the lock shaft 34 by the return spring fasteners 70B. The springs 68B extend to contact the pawls 52B and 54B.

In the locked position, the outer portion 72B extends generally circumferentially below the cam 48B. Similarly, the inner portion 74B which is secured to the handle shaft 32 by spring fastener 50B and extends generally circumferentially to either side thereof. The outer portion 72B and inner portion 74B meet at the doubled over end portions 76B. The end portions 76B have flared legs 78B which form a semi-enclosed loop and are adapted to be received in the cradle 98B and engage the lip 100B of the pilot portion 80B. The legs 78B terminate leaving radial clearance R between the legs 78B and the pilot portion 80B of the pawls 52B and 54B. The legs 78B are also disposed at a circumferential distance C to either side of the pilot portion 80B of the pawls 52B and 54B.

In the locked position, the pilot portion 80B of pawls 52B and 54B extend generally radially outward from the lock shaft 34 and terminate generally radially below each leg 78B of the spring 49B. The cradle 98B and lip 100B are disposed at the outward radial end of the pilot portion 80B. The pilot portion 80B interconnects with the primary portion 84B which is received in recess 102 when the cam 12B is in the locked position. In the locked position, recesses 104 are located generally radially and circumferentially outward of the primary portion 84B of each pawl 52B and 54B. The recesses 104 extend into an interior portion of the handle shaft 32.

The handle shaft 32 and lock shaft 34 are biased into the locked position by return springs (not shown) which engage and rotate the shafts 32 and 34 to the position shown when the handle shaft 32 is not being actuated by the user. In the locked position, the prime mover 44B has not been actuated by the user, and therefore, the cam 48B does not contact the upper portion 72B of the spring 49B. Thus, the radial clearance R exists between the spring 49B and the pawls 52B and 54B and keeps the spring 49B from engaging one of the pawls 52B and 54B if the handle shaft 34 is rotated the user.

Figure 5B:
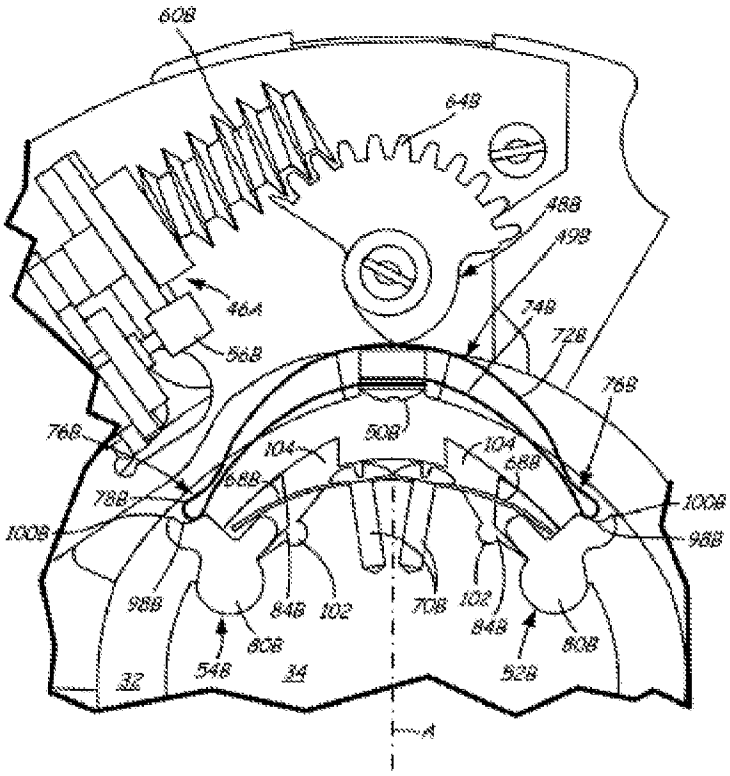
FIG. 5B is a view of the clutch from FIG. 5A with a cam rotated to depress a spring which is secured to a handle shaft.

FIG. 5B shows the cam 48B rotated to depress the spring 49B and eliminate the radial clearance R shown in FIG. 5A. In FIG. 5B, the prime mover 44B has been actuated by the user to drive the gear train 46B to rotate the cam 48B. The pivotal rotation of the cam 48B depresses the outer and inner portions 72B and 74B of the spring 49B, flexing them inward toward the lock shaft 34. The flexing of the outer and inner portions 72B and 74B moves the legs 78B inward to eliminate the radial clearance R (FIG. 5A) between the legs 78B and the pilot portion 80B of the pawls 52B and 54B. More particularly, the legs 78B contact the cradle 98B of each pilot portion 80B and exert an tangential bias on the pawls 52B and 54B due to contact between the legs 78B and the lips 100B.

Figure 5C:
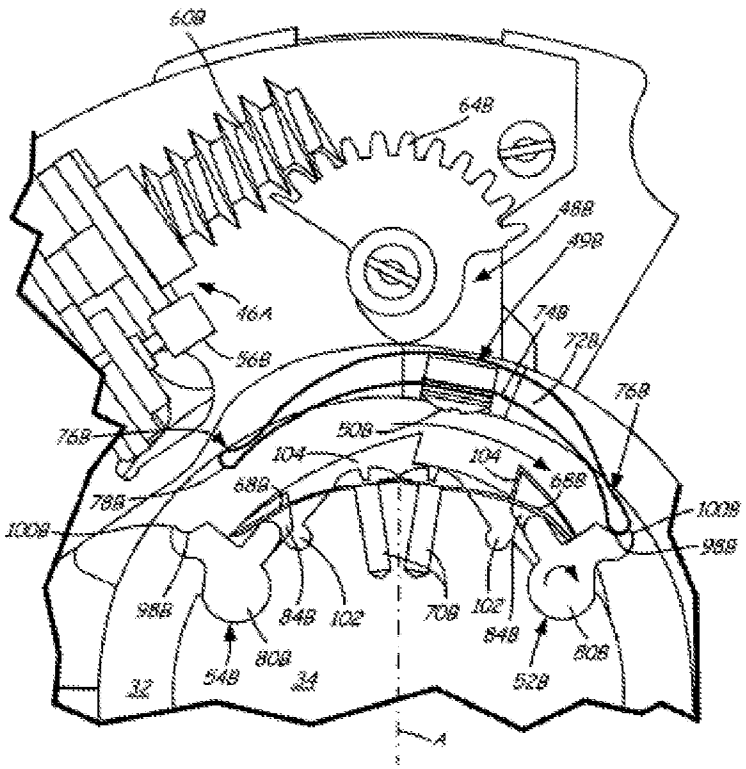
FIG. 5C is a view of the clutch from FIG. 5A with the handle shaft rotated to engage the spring with a pawl.

FIG. 5C shows the handle shaft 32 rotating clockwise to initially engage the spring 49B with the pawl 52B. In FIG. 5C, the cam 48B continues to be pivoted to engage the outer portion 72B of the spring 49B. This engagement depresses the spring 49B to eliminate the radial clearance R (FIG. 5A) between the legs 78B and the pilot portion 80B of the pawls 52B and 54B. The handle shaft 32 rotates clockwise in response the user depressing or rotating the outer handle 22 (FIG. 1). This clockwise rotation allows one of the legs 78B of the spring 49B to engagement with the lip 100B of pawl 52B. The engagement with the lip 100B exerts a tangential pivoting bias on pawl 52B. The clockwise rotation allows the other leg 78B of spring 49B to ride up the cradle 98B of pawl 54B away from the lip 100B such that no tangential pivoting bias is exerted on pawl 54B. The engagement of the leg 78B with the pilot portion 80B places the inner portion 74B of the spring 49B between the leg 78B and the spring fastener 50B in compression.

The first pawl 52B and the second pawl 54B are disposed symmetrically on an opposite sides of an axis of symmetry A of the lock shaft 34. The dual pawl 52B and 54B arrangement allows for bi-directional engagement of the spring 49B with either pawl 52B or 54B to couple the lock shaft 34 with the handle shaft 32. Bi-directional coupling means the user can turn the outer handle 22 (FIG. 1) in either a clockwise or counterclockwise direction (thus rotating the handle shaft 32 in the clockwise or counterclockwise direction) and still engage one leg 78B of the spring 49B with either the first pawl 52B or the second pawl 54B. The spring 49B is doubled over upon itself such that when selectively engaged by the cam 48B the outer portion 72B of the spring 49B deflects to a greater extent than an inner portion 74B of the spring 49B. The greater deflection of the outer portion 72B relative to the inner portion 74B exerts a bias force on the pawl 52B when the spring 49B is engaging the pawl 52B. In FIG. 5C, this bias force tends to pivot the pilot portion 80B of the pawl 52B outward away from the axis of symmetry A and the primary portion 84B of the pawl 52B outward to engage the handle shaft 32.

Figure 5D:
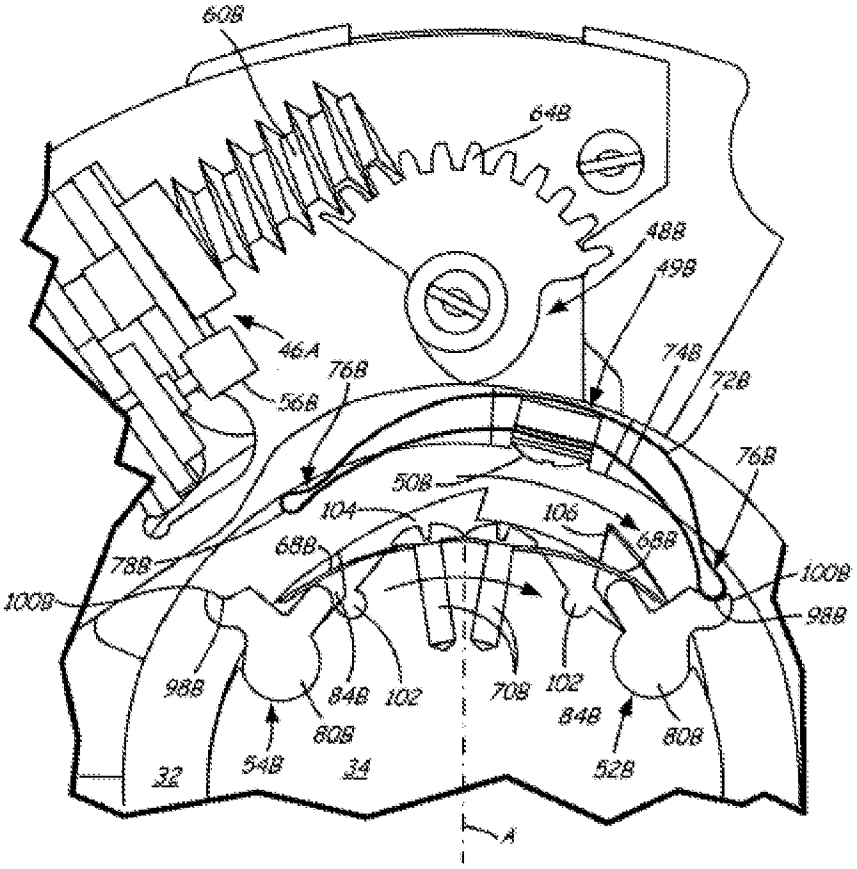
FIG. 5D is a view of the clutch from FIG. 5A with the handle shaft rotated further clockwise such that the spring engaging the pawl has moved a portion of the pawl into a recess in the handle shaft.

FIG. 5D shows the primary portion 84B of the first pawl 52B rotating into recess 104 thereby engaging the pawl 52B with the handle shaft 32. In FIG. 5D, the recess 104 has moved into a position outward of the pawl 52B due to the rotation of the handle shaft 32 relative to the lock shaft 34 while the primary portion 84B has rotated outward due to the engagement of the spring 49B on the pilot portion 80B. More particularly, the primary portion 84B engages a trailing edge surface 106 which defines a portion of the recess 104 to couple the lock shaft 34 with the handle shaft 32.

The clutch 12B utilizes low energy to couple the shafts 32 and 34 due to the use of human (user) torque to rotate the handle shaft 32 into engagement with one of the pawls 52B or 54B. In contrast, the prime mover 44B via the gear train 46B and cam 48B only works to deflect the spring 49B a small radial distance so that the leg 78B of the spring 49B interfaces with and engages the cradle 98B and lip 100B of the pawl 52A or 54A when the handle shaft 32 is rotated by the user. The resulting reduction in operating resistance or load to the prime mover 44B allows the size of the prime mover 44B to be reduced, increases the service life of the batteries 30, and reduces the cost of prime mover 44B and the overall cost of the electronic lock 10. Because the clutch 12B utilizes mainly rotational motion to engage the cam 48B with the spring 49B, the spring 49B with the pawl 52B or 54B, and the pawl 52B or 54B with the handle shaft 32 there are only limited instances of sliding friction in the clutch 12B. Thus, the use of rotational motion engagement in the clutch 12B improves clutch 12B reliability by reducing the likelihood of stiction or binding problems due to the sliding friction associated with linear clutch devices.

Figure 5E:
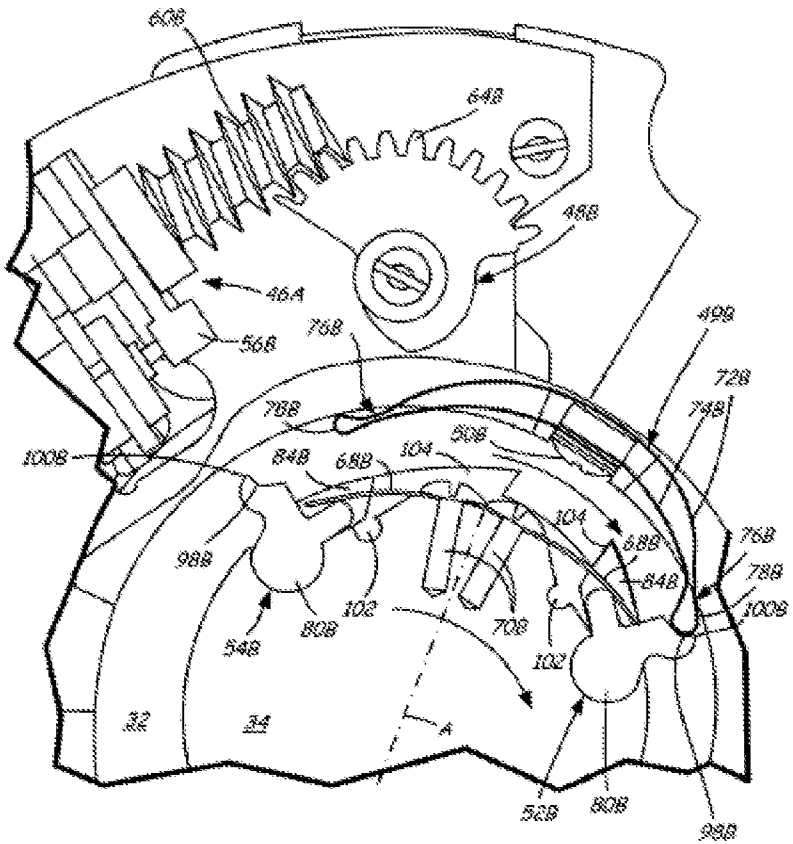
FIG. 5E is a view of the clutch from FIG. 5A with the clutch in an unlocked position.

FIG. 5E shows the clutch 12B in an unlocked position. In the unlocked position, the lock shaft 34 and handle shaft 32 have rotated together to unlock the latch mechanism 16 to allow the user to open the door 14 from an exterior side (FIG. 1). The spring 49B has rotated free of contact with the cam 48B. In the embodiment shown, the radial clearance R has developed between the legs 78B and the pilot portion 80B of each pawl 52B and 54B. In another embodiment, the legs 78B and pilot portion 80B can be adapted to maintain engagement once initially engaged despite the lack of inward cam 48B engagement on spring 49B. The primary portion 84B of the pawl 52B is held in engagement with surface 106 by friction and normal forces caused by the return springs (not shown) engaging the handle shaft 32 and lock shaft 34. As discussed earlier when discussing FIG. 5A, if the user releases the outer handle 22, the shafts 32 and 34 will return to neutral locked positions as illustrated in FIG. 5A. The cam 48B can be rotated back to a non-engaging position above the spring 49B such that the spring 49B is not deflected as it is brought back under the cam 48B. Once in the neutral locked position, the return springs 68B bias the primary portion 84B of pawl 52B back into the recess 102.

Figure 6:
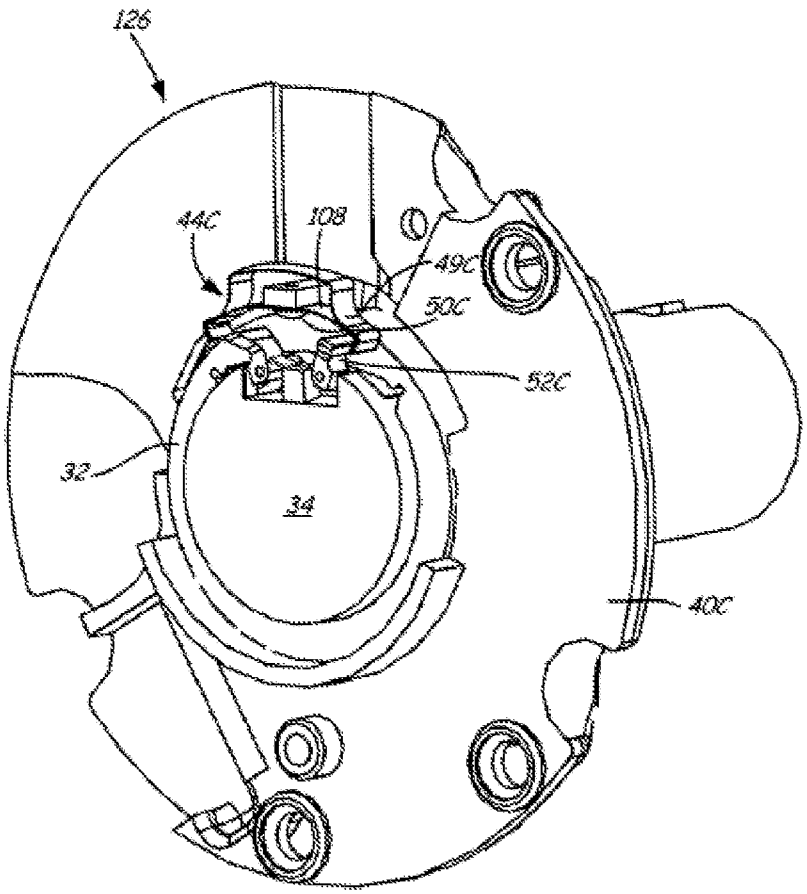
FIG. 6 is a perspective view of another embodiment of the clutch utilizing a piezoelectric material.

FIG. 6 is a perspective view of another embodiment of the clutch 12C with a section of the lock shaft 34 removed to illustrate the components of the clutch 12C. The clutch 12C includes a mounting plate 40C, a primary mover 44C, a spring 49C, a spring fastener 50C, a first pawl 52C and a second pawl 54C. The primary mover 44C includes piezoelectric stripes 108.

In FIG. 6, the mounting plate 40C of the clutch 12C is rotatably connected to the handle shaft 32. The mounting plate 40C is affixed within the mortise of the door 14, the inner escutcheon 20, or outer escutcheon 18 by fasteners (FIG. 1). The lock shaft 34 is axially co-aligned with the axis of rotation of the handle shaft 32. The portion of the lock shaft 34 shown is disposed adjacent the handle shaft 32 and extends within a recess in the handle shaft 32 in one embodiment.

The primary mover 44C (in this case the piezoelectric stripes 108) is disposed on one or more surfaces of the spring 49C. The primary mover 44C is electrically connected to the battery 30 (FIG. 1). The spring 49A is secured to the handle shaft 32 by the spring fastener 50C and terminates adjacent the first and second pawls 52C and 54C. The pawls 52C and 54C are pivotally secured to and extend outward from the lock shaft 34. When engaged by the spring 49C, a portion of pawl 52C or 54C rotates outward from the lock shaft 34 to engage the handle shaft 32.

When a valid clearance is presented to the reader 24, electrical current is supplied from the battery 30 to the primary mover 44C. The piezoelectric stripes 108 bend in response to the application of current. The deflection of the piezoelectric stripes 108 deflects the spring 49C generally inward toward the lock shaft 34 to eliminate a radial clearance between the spring 49C and the pawls 52C and 54C. The handle shaft 34 can then be rotationally actuated by the user to eliminate a circumferential clearance between the spring 49C and one of the pawls 52C or 54C. The rotation of the handle shaft 34 engages the spring 49C with one of the pawls 52C or 54C, the contacted pawl 52C or 54C pivots in response to the engagement into with the handle shaft 32 to couple the lock shaft 34 with the handle shaft 32.

In another embodiment, a piezoelectric bender can be substituted entirely for the spring 49C. In response to current, the piezoelectric bender would deflect to directly engaged and pivot one of the pawls. In yet another embodiment, the spring 49C could be secured to the lock shaft 34 and the pawls 52C and 54C to the handle shaft 32 rather than the handle shaft 32 and lock shaft 34 as illustrated in FIG. 6. In this alternative configuration, the spring 49C would engage and pivot the pawl 52C or 54C into coupling engagement with the lock shaft 34 rather than the handle shaft 32 as illustrated.

Figure 7A:
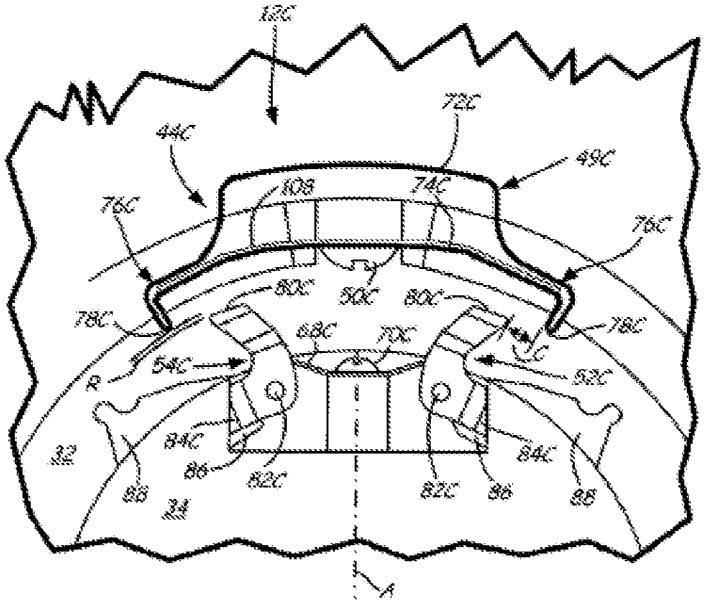
FIG. 7A is a view of the embodiment of the clutch from FIG. 6 in a locked position.

FIG. 7A shows the clutch 12C in the locked position with a section of the lock shaft 34 removed. The clutch 12C includes return springs 68C and a return spring fastener 70C. The spring 49C is doubled over upon itself to include an outer portion 72C and an inner portion 74C which interconnect at end portions 76C. In the embodiment shown, the inner portion 74C has piezoelectric stripes 108 disposed thereon. The end portions 76C are adapted to include legs 78C. The first and second pawls 52C and 54C each include a pilot portion 80C, an aperture 82C, and a primary portion 84C. The lock shaft 34 includes recesses 86. The handle shaft 32 includes recesses 88.

The lock shaft 34 is adapted to receive the return springs 68C therein. The return springs 68C are secured to the lock shaft 34 by the return spring fastener 70C. The springs 68C extend to contact the pawls 52C and 54C.

In the locked position illustrated, the spring 49C is disposed relative to the pawls 52C and 54C such that a radial clearance R exists between the pawls 52C and 54C and the outer portion 72C of the spring 49C. The outer portion 72C extends generally above the inner portion 74C, which is secured to the handle shaft 32 by spring fastener 50C. The inner and outer portions 72C and 74C and extend generally circumferentially to either side of the spring fastener 50C. The inner portion 74C has the piezoelectric material layered or otherwise affixed to a surface thereof. However, the positioning of the piezoelectric material is merely exemplary, and therefore, the material could be disposed on the other portions of the spring 49C to accomplish deflection thereof. The outer portion 72C and inner portion 74C meet at the doubled over end portions 76C. The end portions 76C have legs 78C which extend generally radially inward toward the lock shaft 34 and are adapted to engage the pilot portion 80C of pawls 52C and 54C. The legs 78C terminate leaving radial clearance R between the legs 78C and the pilot portion 80C of the pawls 52C and 54C. The legs 78C are also disposed at a circumferential distance C to either side of the pilot portion 80C of the pawls 52C and 54C.

In the locked position, the pilot portion 80C of pawls 52C and 54C extend generally radially outward from the lock shaft 34 and terminate radially adjacent each leg 78C of the spring 49C. The aperture 82C extends through the inner part of the pilot portion 80C and is adapted to receive a fastener or stud (not shown) which pivotally secures each pawl 52C and 54C to the lock shaft 34. The pilot portion 80C interconnects with the primary portion 84C which is received in recess 86 when the cam 12C is in the locked position. In the locked position, recesses 88 are located generally radially and circumferentially outward of the primary portion 84C of each pawl 52C and 54C. The recesses 88 extend into an interior portion of the handle shaft 32.

The handle shaft 32 and lock shaft 34 are biased into the locked position by return springs (not shown) which engage and rotate the shafts 32 and 34 to the position shown when the handle shaft 32 is not being actuated by the user. In the locked position, the prime mover 44C has not been actuated by the user, and therefore, the cam 48C does not contact the upper portion 72C of the spring 49C. Thus, the radial clearance R exists between the spring 49C and the pawls 52C and 54C and keeps the spring 49C from engaging one of the pawls 52C and 54C if the handle shaft 34 is rotated the user.

Figure 7B:
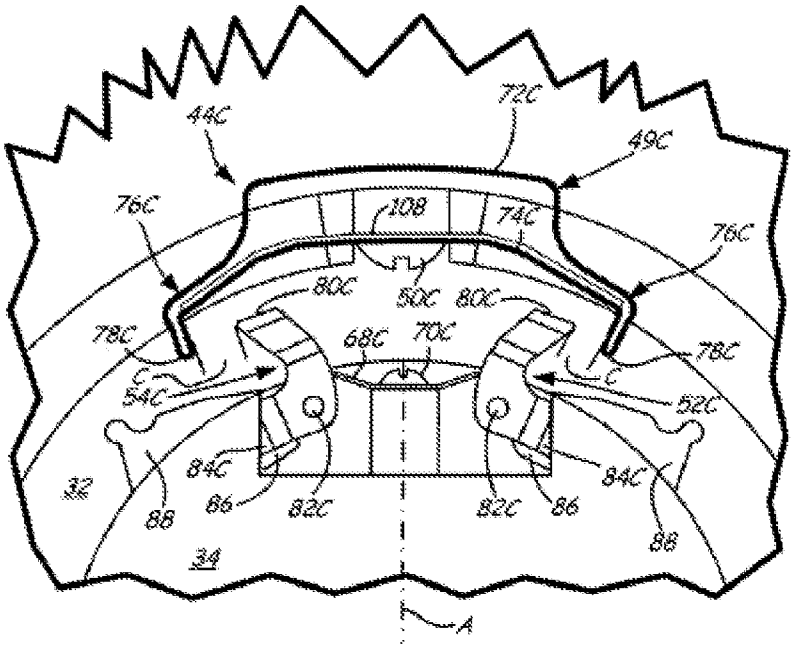
FIG. 7B is a view of the clutch from FIG. 7A with the piezoelectric material electrically activated to depress a spring which is secured to a handle shaft.

FIG. 7B shows the cam 48C rotated to depress the spring 49C and eliminate the radial clearance R shown in FIG. 7A. In FIG. 7B, the prime mover 44C has been actuated by the user's presenting a valid security card or other means to the reader 24 (FIG. 1). The primary mover 44C is supplied with current causing the piezoelectric material 108 to deflect thereby deflecting the outer and inner portions 72C and 74C of the spring 49C inward toward the lock shaft 34. The deflection or flexing of the outer and inner portions 72C and 74C moves the legs 78C inward to eliminate the radial clearance R (FIG. 3A) between the legs 78C and the pilot portion 80C of the pawls 52C and 54C, circumferential clearance C still exists between the pilot portion 80C and the legs 78C.

Figure 7C:
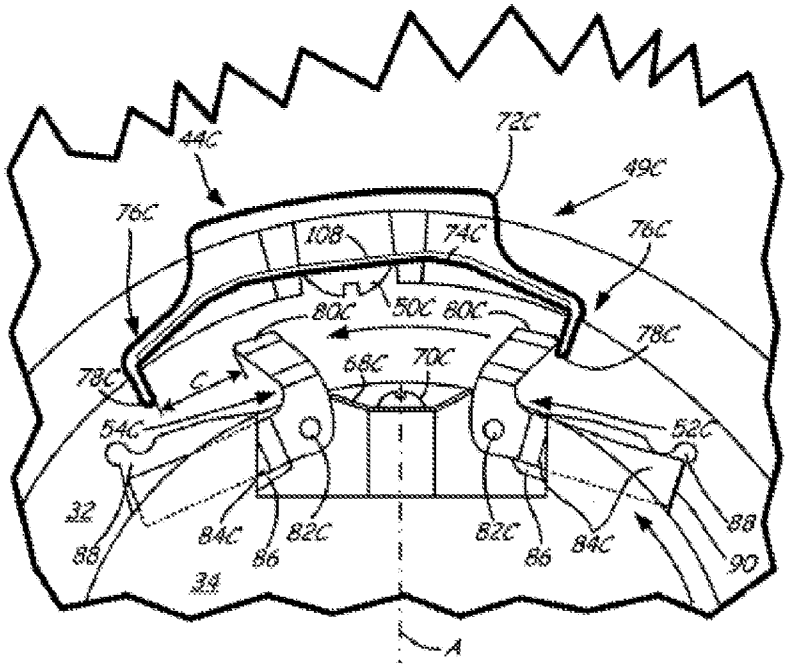
FIG. 7C is a view of the clutch from FIG. 7A with the handle shaft rotated counterclockwise such that the spring engaging the pawl has moved a portion of the pawl into a recess in the handle shaft.

FIG. 7C shows the primary portion 84C of the first pawl 52C rotating into recess 88 thereby engaging the pawl 52C with the handle shaft 32. In FIG. 7C, the recess 88 has moved into a position outward of the pawl 52C due to the rotation of the handle shaft 32 relative to the lock shaft 34 while the primary portion 84C has rotated outward due to the engagement of the spring 49C on the pilot portion 80C. More particularly, the primary portion 84C engages a trailing edge surface 90 which defines a portion of the recess 88 to couple the lock shaft 34 with the handle shaft 32.

The clutch 12C utilizes low energy to couple the shafts 32 and 34 due to the use of human (user) torque to rotate the handle shaft 32 into engagement with one of the pawls 52C or 54C. In contrast, the prime mover 44C is supplied only with a small amount of current to deflect the spring 49C a small radial distance so that the leg 78C of the spring 49C interfaces with and engages the pilot portion 80C of the pawl 52C or 54C when the handle shaft 32 is rotated by the user. The resulting reduction in operating resistance or load the prime mover 44C experiences increases the service life of the batteries 30, reduces the cost of prime mover 44C, and the overall cost of the electronic lock 10. Because the clutch 12C utilizes mainly rotational motion to engage the spring 49C with the pawl 52C or 54C and the pawl 52C or 54C with the handle shaft 32, there are only limited instance(s) of sliding friction in the clutch 12C. Thus, the use of rotational motion engagement in the clutch 12C improves clutch 12C reliability by reducing the likelihood of stiction or binding problems due to the sliding friction prevalent in linear clutch devices.

Although the present invention has been described with reference to preferred embodiments, workers skilled in the art will recognize that changes may be made in form and detail without departing from the spirit and scope of the invention.

The invention claimed is:

1. A drive clutch for an electronic door lock, the clutch comprising:

a rotatable first shaft having a movable mechanism coupled thereto;

a second shaft axially co-aligned with and rotatably disposed adjacent the first shaft;

a pivotal pawl rotatably coupled to the second shaft; and a prime mover selectively actuatable to eliminate a clearance between the movable mechanism and the pivotal pawl such that rotation of the first shaft relative to the second shaft by a user causes the movable mechanism to engage the pawl to pivot the pawl into coupling engagement between the first shaft and the second shaft.

2. The clutch of claim 1, wherein the movable mechanism is a spring mechanism which is deflected by the prime mover for engagement with the pawl.

3. The clutch of claim 2, further comprising a latch mechanism operably connected to the second shaft, wherein the engagement of the pawl with the first shaft couples the second shaft with the first shaft to transmit an actuating rotation which unlocks the latch mechanism.

4. The clutch of claim 3, wherein rotation of the first shaft relative to the second shaft is continued past the point where the spring mechanism is engaged with the pawl to unlock the latch mechanism.

5. The clutch of claim 3, further comprising a door handle that is connected to the first shaft such that actuation of the door handle rotates the first shaft relative to the second shaft.

6. The clutch of claim 4, further comprising a cam which is actuated by the prime mover to deflect the spring mechanism toward the second shaft to eliminate a radial clearance between an end portion of the spring mechanism and the pawl before the spring mechanism is actuated into engagement with the pawl by rotation of a door handle.

7. The clutch of claim 2, wherein the spring mechanism is doubled over upon itself such that when selectively engaged by a cam, an outer portion of the spring mechanism deflects to a greater extent than an inner portion of the spring mechanism which is secured to the first shaft, wherein the greater deflection of the outer portion of the spring mechanism with respect to the inner portion of the spring mechanism exerts a bias force on the pawl when the spring mechanism is engaging the pawl.

8. The clutch of claim 1, wherein the clutch has a first pawl and a second pawl, the first pawl is disposed on an opposite side of an axis of symmetry of the second shaft from the second pawl thereby allowing for bi-directional coupling of the second shaft with the first shaft.

9. An electronic door lock, comprising:

a rotatable door handle;

a handle shaft operably connected to the door handle and capable of being rotationally actuated thereby;

a spring mechanism operably coupled to the handle shaft;

a latch mechanism;

a lock shaft axially co-aligned with and rotatably mounted adjacent the handle shaft and rotatably connected to the latch mechanism;

a pawl pivotally coupled to the lock shaft;

a prime mover configured to eliminate a clearance between the spring mechanism and the pawl such that rotation of the handle shaft causes the spring mechanism to engage the pawl thereby coupling the lock shaft with the handle shaft to unlock the latch mechanism.

10. The electronic door lock of claim 9, wherein the spring mechanism is doubled over upon itself such that when selectively engaged by a cam, an outer portion of the spring mechanism deflects to a greater extent than an inner portion of the spring mechanism which is secured to the handle shaft, wherein the greater deflection of the outer portion of the spring mechanism with respect to the inner portion of the spring mechanism exerts a bias force on the pawl when the spring mechanism is engaging the pawl.

11. The electronic door lock of claim 9, wherein rotation of the handle shaft relative to the lock shaft is continued past the point where the spring mechanism is engaged with the pawl to unlock the latch mechanism.

12. The electronic door lock of claim 9, including a first pawl and a second pawl disposed on either side of the spring mechanism which allows for bi-directional coupling of the lock shaft with the handle shaft.

13. A method of coupling a first shaft with a second shaft in an electronic door lock using a pivotal pawl, the method comprising:

actuating a prime mover to eliminate a clearance between a movable mechanism and the pawl; and rotating the first shaft relative to the second shaft to engage the mechanism with the pawl to pivot the pawl into engagement between the first shaft and the second shaft.

14. The method of claim 13, wherein the rotation of the first shaft is continued past the point where the movable mechanism is engaged with the pawl to open a locking mechanism.

15. The method of claim 13, wherein the mechanism comprises a spring which is adapted to engage and pivot either a first pawl or a second pawl.

* * * * *